US006913531B1

(12) United States Patent
Yoseloff

(10) Patent No.: US 6,913,531 B1
(45) Date of Patent: Jul. 5, 2005

(54) POKER GAME WITH A PARLAY BET

(76) Inventor: Mark L. Yoseloff, 1900 Grey Eagle St., Henderson, NV (US) 89014

( * ) Notice: Subject to any disclaimer, the term of this patent is extended or adjusted under 35 U.S.C. 154(b) by 0 days.

(21) Appl. No.: 09/520,402

(22) Filed: Mar. 8, 2000

(51) Int. Cl.[7] ..... A63F 1/00
(52) U.S. Cl. ..... 463/13; 273/274; 273/292
(58) Field of Search ..... 463/13, 11; 273/274, 273/292

(56) References Cited

U.S. PATENT DOCUMENTS

| | | | | |
|---|---|---|---|---|
| 4,743,022 | A | | 5/1988 | Wood |
| 5,011,146 | A | * | 4/1991 | Lamle |
| 5,294,120 | A | | 3/1994 | Schultz |
| 5,356,140 | A | | 10/1994 | Dabrowski et al. |
| 5,486,005 | A | | 1/1996 | Neal |
| 5,531,440 | A | | 7/1996 | Dabrowski et al. |
| 5,570,885 | A | * | 11/1996 | Ornstein |
| 5,639,092 | A | | 6/1997 | Macaisa |
| 5,718,431 | A | | 2/1998 | Ornstein |
| 5,823,873 | A | * | 10/1998 | Moody |
| 5,868,618 | A | * | 2/1999 | Netley et al. |
| 5,882,260 | A | | 3/1999 | Marks et al. |
| 5,988,643 | A | | 11/1999 | Awada |
| 6,004,205 | A | | 12/1999 | Lauretta et al. |
| 6,007,066 | A | | 12/1999 | Moody |
| 6,126,543 | A | * | 10/2000 | Friedman |
| 6,132,311 | A | * | 10/2000 | Williams ..... 463/13 |
| 6,179,711 | B1 | * | 1/2001 | Yoseloff ..... 273/138.1 |

* cited by examiner

*Primary Examiner*—Vishu K. Mendiratta
(74) *Attorney, Agent, or Firm*—Mark A. Litman & Assoc. P.A.

(57) ABSTRACT

A novel casino tale game, network game, computer game or video game comprises a player placing a wager (which may comprise three equal bets) to participate in the play of the game. Multiple card hands (at least two hands and preferably exactly two hands) are provided face down to a player. When there are three bets, the first bet establishes the wager amount for play of the first game; the second bet establishes the wager amount for the play of the second game; and the third bet establishes the wager amount for a parlay event involving the first and second hand. The first hand usually must be played to conclusion after initiation of the game, with winning combinations receiving a predetermined payout according to a pay table. After play of the first hand, the player may a) forfeit one of the two remaining wagers (as when there was no winning hand in the play of the first game), b) or continue play of the second hand. When both hands (the first and second hand) both achieve at least minimum predetermined ranks, a special payout is paid on the parlay third bet. In the play of the game, the player may win one amount on the play of a first hand, a second amount on the play of the second hand, and a third amount on the parlay play of both hands, with an opportunity to win an amount on the play of both hands in the parlay play that is more than additive with respect to the sum that can be won on the individual play of the first and second hands.

29 Claims, 1 Drawing Sheet

POKER GAME WITH A PARLAY BET

BACKGROUND OF THE INVENTION

1. Field of the Invention

The present invention relates to a poker game suitable for use in casinos and other gaming establishments as a casino table poker game particularly in a version as an electronic poker game such as a video poker. The invention further relates to video gaming play where multiple sequences of play may be required with enhanced payouts for consecutive wins.

2. Background of the Art

Games based upon variations of poker have attained enormous popularity as casino-type entertainment games, particularly in the past twenty years. The success of poker games in the gaming industry is partially based on the game's simplicity (i.e., there is widespread public knowledge of the game rules) and the fact that players feel more directly involved in exercising judgment in the play of the game. Furthermore, the technological innovations in computer gaming equipment allow for reasonably fair odds being provided to the draw poker player. Payouts are typically around 85–95%, and some casinos assert higher levels of payouts. The steady generation of revenue provided to casinos by the various poker games contribute to the game's popularity with casinos.

One possible limitation to a still broader expansion of poker in casino operations may be the relatively low hit frequency of the highest ranked reward, the Royal Flush (approximately every 40,000 hands), when compared to the apparent frequency of slot machine jackpots. Additionally, in many poker games, the most frequent events will be a push (e.g., a win that is equivalent to the amount of the original wager) or a loss of the initial wager. Although the addition of wild cards can increase the frequency if winning outcomes and increase the relatively high apparent rank of hands, the win or payouts will normally begin at a higher rank of hands, the win or payouts will normally begin at a higher rank of hand (e.g., at least three-of-a-kind in some wild card games) and he amount of the payout (as a factor of the original wager) will usually decrease with respect to each rank of hand. For example, in five card draw poker (with no wild cards) as compared to five card draw with one rank of card (e.g., deuces) wild, some comparative payouts would include:

| Hand | No Wild Cards | Wild Cards |
|---|---|---|
| Two pair | 2X | 0 |
| Three-of-a-Kind | 3X | 1X |
| Straight | 4X | 2X |
| Flush | 5X | 3X |
| Full House | 8X | 5X |

and the like. The satisfaction of an increased frequency of higher ranked hands is diminished by the reduced payouts for those higher ranked hands.

Many variations of poker and especially draw poker have been developed for casino table games and for video games. Each of these game variations features its own set of rules and/or optimal player strategy. Some game variations attempt to increase the total game outputs and are represented by games such as "Deuces Wild Poker," "Joker Wild Poker," "Bonus Poker," "Double Bonus Poker," "Second Chance Poker," etc. Some games appeal to players by raising the payout percentage to 97% and even higher through an approach of providing bonuses for certain types of winning hands, such as Four of a Kind of Aces, Four of a Kind of Twos, Four of Kind of Threes, etc., as in Bonus Poker and Double Bonus Poker.

Another way in which casinos and gaming equipment manufacturers have attempted to increase the enjoyment and length of time that players spend at the gaming equipment is to add variety to not only the types of games played, but also to the format and strategy of the games played. For example, U.S. Pat. No. 5,356,140 describes a game called Double Play poker in which a player is dealt two five card hands face up. The Player elects one of the hands to be played, and the winning outcome is based upon the play of the single hand chosen. Only one hand can be chosen for play. While this game allows the player to select or play from one of two hands, it does not maintain the other hand in the game, and it does not allow another player to select the other hand.

U.S. Pat. No. 5,868,618 relates to a multi-tier video poker game method including the step of receiving payment from an individual and randomly dealing a first tier poker hand on a video screen observable by the individual. The method additionally includes enabling the individual to play the first tier poker hand in consideration for said payment. Criteria are established for a winning hand and the individual is awarded a payment credit if the first tier poker hand played by the individual meets or exceeds the criteria for a winning hand. The method further includes the step of enabling the individual to selectively either accept payment in an amount equal to or less than the payment credit or to wager the amount on a second tier poker hand to be displayed on the video screen.

U.S. Pat. No. 5,486,005 describes a game that requires each player to make a bet or wager to participate in a round dealt by the dealer. After each player makes a wager, the dealer deals a predetermined like number of initial cards from a standard deck of fifty-two playing cards to a predetermined number of hands. These cards are preferably dealt face up showing the value of each card. The preferred embodiment of the present invention calls for four initial cards to be dealt face up to seven hands; however, the number of initial cards dealt and the number of hands could vary. After the initial cards are dealt, the dealer places odds on each hand according to predetermined guidelines set by the house. An option, if desired by the house, allows the dealer to select two or more of the hands for combination as a field position. The rules allow the player to select a field position to play instead of his hand. If a player chooses the field position instead of one of the hands, and either of the hands selected as part of the field position wins, then the player wins. The odds for winning the field position may be the odds previously selected for each hand or may be new odds placed on the field position by the dealer. After the dealer selects the odds for each hand, and the field position is being utilized, each player selects one of the hands, the field position, or a no-two-pair-or-better position. The no-two-pair-or-better position, which may also be referred to as a no-hand winning position, requires that none of the hands, after all the cards are dealt, have two pairs or better according to the conventional rules of Poker. The conventional rules of Poker set the order of hands in descending order as follows: Straight Flush, Four of a Kind, Full House, Flush, Straight, Three of a Kind, Two Pairs, a Pair, and Highest card. U.S. Patent No. 5,486,005 describes a method and apparatus for playing a poker like game in which distinct hands are dealt to the table and the dealer. Individual players may wager on particular hands (against the dealer or for attaining a minimum predetermined rank). Additionally, there are table odds for events evaluating a multiplicity of the hands (e.g., 6:1 odds for no players' hand having two pair or better).

U.S. Pat. No. 5,718,431 describes a method of playing a casino game (including table and video games [in U.S. Pat. Nos. 5,570,885 and 5,823,873]) wherein increased payouts are achieved by attaining predetermined numbers of consecutive wins at a game of chance, including poker, craps, baccarat, blackjack, etc. Streaks are identified by the dealer, as with a marker. An enhanced payout is achieved with an initial side bet by the player. The game is played in a fairly complex manner comprising the steps of:

(a) providing a conventional game receiving region and a plurality of consecutive win chip receiving regions for the player, each such region identifying a number of consecutive wins starting with the number two and up to a maximum number of chip receiving regions permitted by rules of the game;

(b) the player making a conventional bet of a denomination within the denomination range permitted by rules of the game;

(c) the player making a bet on the occurrence of a predetermined number of consecutive wins by placing the bet in one of a predetermined group of consecutive win bet receiving regions for use by the player, each bet receiving region representing a different number of consecutive wins, the bet being of a denomination permitted by rules of the game;

(d) playing the game of chance;

(e) deciding the winner of the game in accordance with conventional rules of the game;

(f) providing a streak chip for use in monitoring a number of consecutive wins made by the player;

(g) placing the streak chip upon the chip receiving region identifying two consecutive wins to be attempted when the player has won the first game;

(h) repeating step (b) preparatory to the play of the second game;

(i) repeating steps (d) and (e) during the play of each succeeding game;

(j) transferring the streak chip to successively higher numbered consecutive wins bet receiving regions until the streak chip is placed upon the consecutive win bet receiving area in which the consecutive win bet was originally placed; and (k) paying a player an amount equal to the denomination of the consecutive wins bet made by the player at step (c) multiplied by the odds for the consecutive wins selected when the player wins a game following step (j). This procedure is complicated, there are too many aspects that are capable of manipulation and fraud, and there are too many variable odds without a clear and automatic determination of the end of the game.

U.S. Pat. No. 5,882,260 describes a modified poker card game for a computer system in which "Bingo Poker" is played (it actually appears slightly more like "Domino Poker").Individual cards are chosen and then positioned along a grid of multiple hands. The relevant feature is that the method includes "comparing individual hands . . . to corresponding values in a predetermined winning schedule . . . and awarding the player . . . responsive to the total value." The actual hands are not compared, however, nor increases in factors awarded for at least a certain number of hands exceeding a specific predetermined value.

U.S. Pat. No. 5,294,120 describes a video draw poker game in which a player commits to a certain number of replacement cards before viewing a hand. The number of cards drawn may be altered, along with alteration of the payout, after viewing of the hand. The play is of interest because this is a significant deviation from normal strategy, and the strategy of the play of the game must be effected before the hand is viewed. This could lead to significant disappointment in the play of the game, as where cards must be replaced with a winning hand, and the replacement destroys or lowers the rank of the winning hand.

U.S. Pat. No. 4,743,022 in effect describes a single card draw, five card poker game, in which a five card hand is dealt, and the hand may be altered by drawing a sixth card (only). The draw of a sixth card alters the pay table.

U.S. Pat. No. 6,007,066 describes a game in which a base poker hand may be provided on the screen a multiple number of times (e.g., the same original five card poker hand being shown up to 100 times on a video screen). The player elects to replace specific cards from the base hand, and each hand is randomly dealt from a separate deck, replacement cards for the discarded cards. Each hand is evaluated with respect to the rank of that hand, and individual payouts are made for each hand and the total sum of individual hand payouts is credited to the player. In essence, a single hand may be played up to 100 times at the same time on a single screen. There is no interactive payout when identical hands or significant numbers of highly ranked hands occur.

Numerous patents also show poker being an alternative or contemporaneous game with other casino games (e.g., U.S. Pat. No. 5,988,643; 5,639,092.), but with no interactive payout when hands of a particular poker rank and hands of a specific value (e.g., a blackjack) are achieved at the same time or consecutively.

Heretofore it has been well known to play a variety of different games with a standard deck of fifty-two playing cards, including Blackjack, Poker, Bridge, Gin Rummy, etc. Games such as Blackjack are universally played in casinos and other such establishments because each player plays against the dealer or house and because they provide an edge to the dealer or house. Likewise, video draw poker machines in which a player individually plays against the house are widely found in casinos. In the video draw poker games there is an advantage to the house because the player needs a hand having a pair of Jacks or better to win. Other poker games, such as Seven-Card Stud, are not generally played in casinos because the rules of Poker require players to play against each other instead of each player playing against a single dealer or the house. The casinos are thus unable to profit from running such games. Moreover, in some poker games each player has one hand even though some variations allow the players to share certain cards. This limits the excitement of such games especially when a player initially receives a poor or relatively low ranked hand. Accordingly, there is a need for an exciting poker-like game in which each player has the opportunity to win larger payouts within the play of a game, even with hands of intermediate winning ranks.

SUMMARY OF THE INVENTION

A player places a wager (which may comprise three equal bets) to participate in the play of the game. Multiple card hands (at least two hands and preferably exactly two hands) are provided face down to a player. When there are three bets, the first bet establishes the wager amount for play of the first game; the second bet establishes the wager amount for the play of the second game; and the third bet establishes the wager amount for a parlay event involving the first and second hand. The first hand must be played to conclusion after initiation of the game, with winning combinations receiving a predetermined payout according to a pay table. After play of the first hand, the player may a) forfeit one of the two remaining wagers (as when there was no winning hand in the play of the first game), b) or continue play of the second hand. When both hands (the first and second hand) both achieve at least minimum predetermined ranks, a special payout is paid on the parlay third bet. In the play of the game, the player may win one amount on the play of a first hand, a second amount on the play of the second hand, and a third amount on the parlay play of both hands, with an opportunity to win an amount on the play of both hands in the parlay play that is more than additive with respect to the sum that can be won on the individual play of the first and second hands.

DETAILED DESCRIPTION OF THE INVENTION

Figure 1:
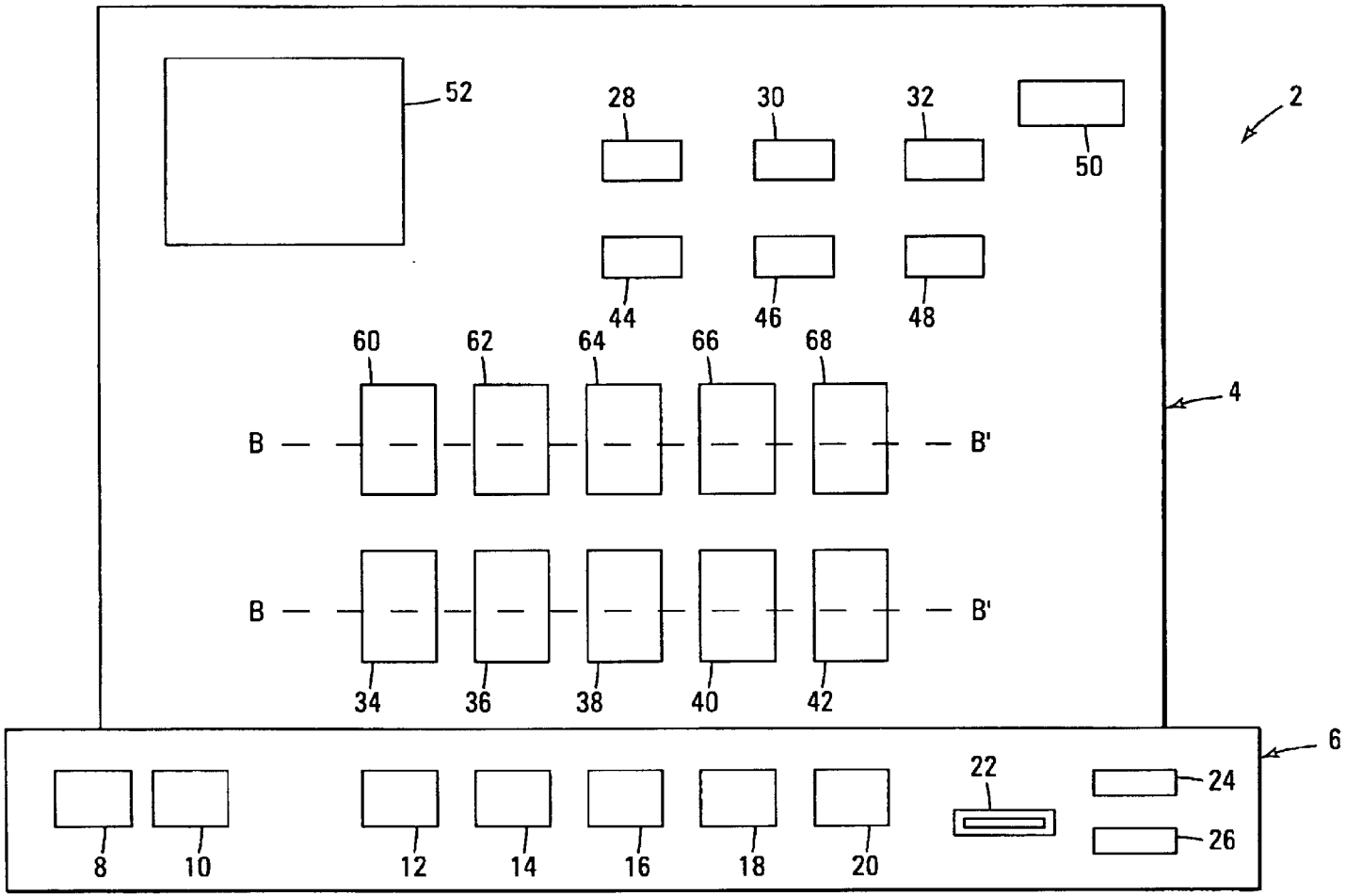
FIG. 1 shows a typical video screen and video gaming apparatus for play of a game according to the practice of the present invention.

An electronic video gaming system or casino table card game is provided where multiple hands of poker are played simultaneously, consecutively or in a staggered fashion. By "poker" is meant one or more of the many variations of poker as it is known in the gaming art, including but not limited to 3, 4, 5, 6, or 7 card games, stud poker games (cards are dealt to complete a hand without the possibility of replacement), draw poker games (where cards are dealt in an initial hand, and then none, one or more than one, up to the total number of cards in the hand, may be replaced), wild card poker games of both the stud and draw varieties (where a special wild card or joker, or a specified rank, suit or rank and suit set of cards is 'wild,' being useful as any card designated by in the player or house), Pai Gow Poker, and other variations of card games that are referred to in the art as poker games. Cards as used in the practice of the present invention include images of cards as well as physical cards.

A basic and general description of the practice of the invention is as a method of playing a wagering game with at least two consecutive plays comprising:

placing at least one bet;

receiving at least one first set of symbols from which a rank may be determined in reading the symbols;

determining the rank of the first set of symbols;

comparing the rank of the first set of symbols to a payout table;

determining whether the rank of said first set of symbols exceeds a minimum rank in the payout table;

receiving at least a second set of symbols from which a rank may be determined;

determining the rank of the second set of symbols;

comparing the rank of the second set of symbols to a payout table;

determining whether the rank of said second set of symbols exceeds a minimum rank in the payout table;

resolving the at least one bet with respect to whether a) the first set of symbols exceeds a minimum rank in the payout table; b) the second set of symbols exceeds a minimum rank in the payout table; and c) first set of symbols and the second set of symbols exceed a minimum rank in the payout table. The resolution of the bet may be with respect to whether both the first set of symbols and the second set of symbols exceed a specific minimum rank in the payout table and may require that the rank of both the first set of symbols and the second set of symbols both exceed a minimum rank in the payout table for the resolution of the bet on c) to provide a return on the bet. The method may select the basis for the parlay payout in a number of different ways. Where the hands are of equal rank stature (e.g., both straights, both two pair, irrespective of the relative rank within those categories), the basis of the parlay will almost certainly be a payout based on that rank stature (e.g., straight or two pairs, respectively). When the two games have different ranks, yet both are above the minimum qualifying for parlay payouts, a number of different formats may be used. The simplest is to compare the two hands, select the lowest rank of the two hands, and establish a payout table based upon that lowest rank. For example, if the hands comprise a straight and a flush, the hands would be considered as two hands of at least a rank of a straight. The parlay payout would be based upon that collective, minimum value rank. Similarly, if the hands were a full house and a Royal Flush, the payout for the first hand would be for a full house, the payout for the second hand would be for a Royal Flush, and the parlay payout would be for two hands having a rank of at least a full house. Another format would be to have the rank of the first hand determine the parlay payout scale, the rank of the second hand determine the parlay payout scale, an averaging of the two hands determine the parlay payout scale, or have a specific predetermined scale for the parlay payouts.

Another way of describing the play of the invention when cards are specifically used as the symbols would be as a method of playing a wagering game of cards with at least two consecutive hands of card games being played, the method comprising:

placing at least one bet;

receiving at least one first hand of cards from which a rank may be determined;

determining the rank of the first hand of cards;

comparing the rank of the first hand to a payout table;

determining whether the rank of said first hand exceeds a minimum rank in the payout table (and optionally resolving that wagering event or indicating the resolution of that wagering event or waiting until the completion of further play before resolving this wagering event or wagering portion);

receiving at least a second hand of cards from which a rank may be determined;

determining the rank of the second hand of cards;

comparing the rank of the second hand to a payout table;

determining whether the rank of said second hand exceeds a minimum rank in the payout table (and optionally resolving that wagering event or indicating the resolution of that wagering event or waiting until the completion of further play before resolving this wagering event or wagering portion);

Resolving the at least one bet with respect to whether a) the first hand of cards exceeds a minimum rank in the payout table; b) the second hand of cards exceeds a minimum rank in the payout table; and c) first hand of cards and the second hand of cards both exceed a minimum rank in the payout table. The method may have all hands dealt from one or more decks of playing cards or a virtual deck or decks of playing cards. The deck of playing cards is most often a standard deck of fifty-two cards, but may comprise specialty decks of cards (e.g., a Spanish 21™ deck of cards with the 10's missing, a canasta deck, a deck with wild cards, etc.). All ranks may be determined as poker ranks. All minimum ranks may be at least one pair. The at least one bet may comprise one, two or three bets. With three bets (three distinct wagering portions or segments, for example), one bet would be allocated towards a), one bet would be allocated towards b), and one bet would be allocated towards c).

Another way of describing play of the game of the invention is as a method of playing a video wagering game with at least two consecutive hands of a card game being played comprising:

placing at least one bet;

receiving at least one first hand of cards (e.g., a vial hand of cards) from which a rank may be determined;

determining the rank of the first hand of cards;

comparing the rank of the first hand to a payout table;

determining whether the rank of said first hand exceeds a minimum rank in the payout table (and optionally resolving that wagering event or indicating the resolution of that wagering event or waiting until the completion of further play before resolving this wagering event or wagering portion);

receiving at least a second hand of cards from which a rank may be determined;

determining the rank of the second hand of cards;

comparing the rank of the second hand to a payout table;

determining whether the rank of said second hand exceeds a minimum rank in the payout table (and optionally resolving that wagering event or indicating the resolution of that wagering event or waiting until the completion of further play before resolving this wagering event or wagering portion);

resolving the at least one bet with respect to whether a) the first hand of cards exceeds a minimum rank in the payout table; b) the second hand of cards exceeds a minimum rank in the payout table; and c) first hand of cards and the second hand of cards both exceed a minimum rank in the payout table. This method can clearly and easily utilize a format where the at least one bet comprises three bets, with one bet allocated towards a), one bet allocated towards b), and one bet allocated towards c).

Yet another way of describing the present invention is as a method of playing a wagering game that includes the steps of:

placing at least a one part bet or bet unit;

playing a first wagering game segment whose game outcome depends at least in part upon the random selection or appearance of game symbols;

comparing a first segment game outcome to the rules of the game to determine if a payout is associated with the first segment game outcome;

playing a second (or more) wagering game segment whose outcome depends at least in part upon the random selection or appearance of game symbols;

awarding the player a first payout when the first segment game outcome is determined to be a winning outcome;

awarding the player a second (or more) payout when the second (or more) game outcome is determined to be a winning outcome; and when consecutively played first and second (or more) game segments both have winning outcomes, paying the player a third payout for the consecutive winning outcomes.

In this embodiment, the game may be a card game with well established hand rankings such as poker, or may be another type of card game in which the player's hand must beat the rank of the dealer's hand. Examples of such games include War, Blackjack and Caribbean Stud™ poker. The rules of the game in this instance include paying the player a payout for beating the dealer in two or more consecutive hands. In one example, the player places a mandatory three part wager and wins the third or "parlay" wager or payout only if the player beats the dealer with both consecutively played hands.

In another embodiment, the first and second game segments are video, computer, network or electromechanical reel slot games. The player places a three part bet and wins the third bet only if outcomes are obtained in the first and second identical or different reel slot games that award a payout. The lower ranking outcome will usually determine the payout on the parlay bet (the third bet segment). Reel slot games are ideal for practicing this invention as the games are typically designed with a table of winning outcomes. The outcomes typically have a rank, paying higher amounts for combinations that occur less frequently.

In the play of the at least two simultaneous (both hands may be shown at the same time and all wagers resolved), consecutive (one hand is shown and played, then after conclusion, the other hand is shown and played) or staggered hands (one hand is partially displayed and a second hand is also partially displayed, with resolution not occurring until after all hands have been displayed) of poker, the respective at least two hands may be used in the same or different games of poker. It generally simplifies the play of the game for a player to have the at least two poker games played according to the same rules. When both games are the same, the pay table is typically the same for the play of both individual hands /or and games. The play of different games for the at least two hands can add further interest to play and/or affect the statistics of play, including the hold for the house and the return for the player. For example, to increase the interest and likelihood of a player remaining active in the play of a second hand, the first hand/game may be seven card stud, where there can be an increased frequency of higher ranked hands then with five card stud or even five card draw. The pay tables would, of course, be adjusted to reflect the potential for higher ranking of first hands.

A general description of the various formats of play is now provided. Play is initiated by either a) the initial bets/wagers are placed and then the at least two hands are dealt (with both hands face down, or with the second hand face down and any desired portion of the first hand, including all cards, dealt face up) or b) the at least two hands dealt face down and then the bets/wagers placed. A format for the game includes the placement of a single wager or single unit wager for play of all three payout options (later described), two equal bets, or three equal bets (with the total number of bets possibly determinable as equal to the number of hands to be played plus one, as in the standard game described herein with two hands and the bets therefore equal to two plus one). A particularly desirable format of play is with two hands and three bet units. The bet units may be equal or unequal within the guidelines of house rules. Description of the game with two hands, and three equal bets is used to simplify some of the descriptions and strategies. After an initial placement of three equal bets, the first hand is dealt. (The second hand may also be dealt, face down at this time, or may be kept by the dealer/virtual deck). The cards in the first hand may be dealt face up (after a first bet or all of the bets have been placed, of course ). The cards may have their faces displayed one at a time, multiple cards at a time, or all of the cards at once to control the excitement of the game.

After the display or exposure of all of the cards in the first hand, the hand is evaluated (by a dealer or artificial intelligence to determine whether a hand of at least a predetermined value exists in the player's first hand) so that credits should be awarded to the player for the value of that hand.

After determination of whether or not the predetermined hand has been achieved, the game may be played with some variations possible. The player may a) have to continue with the play of the second hand, with all original wagers still in play, or b) have an election of withdrawing some, but not all of his original wager and forfeiting the remainder. Each of these aspects and their influence on the play of the game and it strategy will be discussed.

Compulsory Play of the Game

After the first hand value has been completely determined and the hand assessed (and after awards or credits have been provided), one format requires that the player continue with the play of the second hand, with all wagers in place, even though the failure to attain a hand of the required at least minimum rank (e.g., at least a pair, at least a pair of sixes, at least a pair of Jacks, and the like) has eliminated the possibility of a parlay award. This format of play clearly establishes an easily determined hold for the house and return potential for the player.

Exercising Options in Play

After the first hand value has been completely determined and the hand assessed (and after awards or credits have been provided), another format allows the player to elect paths of play. The player may elect to continue with conventional play of the second hand, even recognizing that the player will not win on the parlay wager. The player may therefore be playing essentially only the second hand as a regular poker hand according to the rules of the game. The player may also elect to forfeit at least a portion of his original bets/wagers, usually in an amount of at least half of the bets or wagers still in play. For example, if the original bets consisted of three $5 wagers, and the first hand was less than the required predetermined amount for a win or possible payout in the parlay wager, there will still be two $5 bets in play. The player may then elect to continue with ordinary play of the second hand (essentially forfeiting the parlay bet unit) or may elect to withdraw at most $5, forfeiting $5 to the house. The only difference between the strategy in these two options being that the player is engaged in conventional play of the second hand, knowing that in either event $5 of the remaining $10 will be lost for certain.

A preferred method of play in the practice of this invention is to have the game defined, controlled and played by a player on a mechanical device, especially a software driven computer, as is used with modern casino wagering apparatus known in the art as video wagering devices. It should be understood that manipulations within the computer are often referred to in terms such as creating, connecting, comparing, moving, displaying, determining, uploading, downloading, selecting, playing, and the like, which may be associated with manual operations performed by a human operator as well as with automatic or artificial intelligence driven functions by hardware, software, mixed hardware software functions, or other artificial intelligence systems. The operations described herein, except where manually initiated (such as button pushing, coin or currency manipulation, joy stick manipulation, light wand direction, touch screen manipulation, and the like) are machine operations performed in conjunction with various inputs provided by a human operator or user that interacts with the computer.

In addition, it should be understood that the programs, processes, methods, etc. described herein are not related or limited to any particular computer, software, operating system or apparatus, nor are they related or limited to any particular communication architecture. Rather, various types of general purpose machines may be used with program modules constructed in accordance with the teachings described herein. Similarly, it may prove advantageous to construct a specialized apparatus to perform the method steps described herein by way of dedicated computer systems in a specific network architecture with hard-wired logic or programs stored in nonvolatile memory, such as read only memory. Additionally, the methods described herein may be practiced on a universal gaming system apparatus such as that described in copending U.S. patent application U.S. Ser. No. 09/405,921 filed on Sept. 24, 1999 titled "Gaming Apparatus for Wagering with Universal Computer Motherboard", which Application is incorporated herein by reference for its disclosure of such architecture, harness, I/O systems, hardware and software.

An Exemplary Operating Environment

The following discussion is intended to provide a brief, general description of the suitable computing environment in which the invention may be implemented. While the invention will be described in the general context of an application program that runs on an operating system in conjunction with a personal computer, those skilled in the art will recognize that the invention may also be implemented in combination with other program modules. Generally, program modules include code, applets, routines, programs, components, objects, data structures, etc., that perform particular tasks or implement particular abstract data types. Moreover, those skilled in the art will appreciate that the invention may be practiced with other computer system configurations, including hand-held devices, multiprocessor systems, microprocessor-based or programmable consumer electronics, LAN (large area networks) networks, WAN (wide area networks) networks, minicomputers, mainframe computers, and the like. The invention may also be practiced in distributed computing environments where tasks are performed by remote processing devices that are linked through a communication network. In a distributed computing environment, program modules may be located in both local and remote memory storage devices.

An exemplary non-limiting system for implementing the present invention includes a conventional personal computer (also referred to as a client computer), including a processor or microprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes to other optical media). The hard disk drive, magnetic disk drive, and optical disk drive may be connected to the system bus by any mechanism such as a hard disk drive interface, a magnetic disk drive interface, and/or an optical drive interface, respectively. The drives and their associated computer-readable media provide non-volatile storage for the personal computer. Although the description of computer-readable media above includes the hard disk drive, a removable magnetic disk and an optical disk, such as a CD, it should be appreciated by those skilled in the art that other types of media which are readable by a computer, such as magnetic cassettes, flash memory cards, digital video disks and tapes, Bernoulli cartridges, and the like, may also be used in the exemplary operating environment.

A number of program modules may be stored in the drives and RAM, such as an operating system and a network browsing program module. In general, the network browsing program module is a tool used to interact with other computers over data networks, such as the Internet and the World Wide Web. The network browsing program module is also a tool capable of using downloadable program modules, such as the puzzle control module, in order to direct operation of the personal computer. The drives and RAM may also store other program modules, and program data (such as image data, player input data, random number generators, comparator data [for comparing hands and comparing results with lookup tables], and other game play data).

The operating system, in conjunction with the BIOS and associated device drivers, may provide the basic interface between the computer's hardware and software resources, the user, and program modules such as the network browsing software module. A user may enter commands and information into the personal computer through a touchpad, button panel, touch screen surface, light wand surface, joy stick, and/or keyboard and an input or pointing device, such as a mouse. Other input devices (not shown) may include a microphone, a joystick, a game pad, a tracking ball, a light wand, a light gun, a satellite dish, a scanner, or the like. These and other input devices are often connected to the processor through a serial port interface, such as a game port or a universal serial bus (USB). A monitor or other type of display device (e.g., public view screen, integrated monitors, serial monitors, grid monitors, and the like, with any imaging format, such as CRT, plasma screen, projection viewing, Liquid Crystal display, etc.) is also connected to the system bus via an interface, such as a video adapter. In addition to the monitor, personal computers typically include other peripheral output devices (not shown), such as printers, peripheral light displays, and speakers.

The personal computer may operate in a networked environment using logical connections to one or more remote programmable devices, such as a remote computer. The remote computer may be a server, a router, a peer device, or other common network node. Typically, the remote computer includes many or all of the elements described relative to the personal computer. In one embodiment of the present invention, the remote computer's memory storage device contains data (such as the game control module and the game data) which may be downloaded to the personal computer. The memory storage device also contains program modules (such as the game server module) which may be used by the remote computer when communicating with the personal computer. This type of format may be particularly desirable where there is related play, as among various similar devices, when associated in a bank of video gaming equipment or when there is a coordinated jackpot function, with numerous video gaming systems engaged in potential jackpot play, within one bank of computers, within one casino, within multiple casinos, or within many different gaming jurisdictions.

The logical connections depicted may include a local area network (LAN) and a wide area network (WAN). Such networkingenvironmentsarecommonplaceincasinos,offices, enterprise-wide computer networks, intranets and the global Internet. When used in a LAN networking environment, the personal computer is connected to the local network through a network interface. When used in a WAN networking environment, the personal computer typically includes a modem or other means for establishing communications over the wide area network, such as the global Internet. The modem, which may be internal or external, is connected to the system bus via the serial port interface. In a networked environment, program modules relative to the personal computer, or portions thereof, may be stored in the remote memory storage device. It will be appreciated that the network connections show are exemplary and other means of establishing a communications link between the personal computer and the remote computer may be used.

As discussed earlier, one embodiment of the present invention is embodied in the game control module within the video gaming apparatus as software, hardware or a combination of software and hardware. The game control module essentially controls the previously discussed computerized game. In one operating environment, the game control module is used in conjunction with a network browsing program module, which is supported by an available operating system. Such as Microsoft Corporation's "WINDOWS 95" or "WINDOWS NT" operating systems, LINUX, UNIX, or the like. However, it should be understood that the invention can be implemented for use with other network browsing program modules and with other operating systems and hardware, such as Microsoft Corporation's "WINDOWS 3.1" operating system, IBM Corporation's "OS/2" and "AIX" operating systems, SunSoft's "SOLARIS" operating system used in workstations manufactured by Sun Microsystem, Hewlett-Packard's "HP-LUX" and "RT-UX" operating systems, and the operating system used in "MACINTOSH" computers manufactured by Apple Computer, Inc.

From this brief description, it should be appreciated that operating systems, such as the "WINDOWS 95" and "WINDOWS NT" operating system, are quite complex and provide a wide variety of services that allow users and programs to utilize the resources available in the personal computer. Those skilled in the art will be familiar with operating systems and their various features. For more comprehensive information regarding the "WINDOWS 95" and "WINDOWS NT" operating system and its interaction with programs, the reader may refer to any of a variety of publications, including the "Win32 Programmer's Reference" and "Advanced Windows", both published by Microsoft Press.

Play of the Game

The following description, in conjunction with a view of FIG. 1, will be provided as a detailed description of the play of a single hand of the game of the invention, executed on a video gaming apparatus with hardware and software enabling the game.

A player at a video gaming apparatus places a wager in the apparatus or system (by coins, currency, crediting, debiting or the like). In this example, three identical wagers of $0.25 (twenty-five cents) are placed into the play of a single game. A rough view of a video gaming apparatus 2 on which the game of the present invention may be readily played is shown. The apparatus 2 comprises a display panel 4 (e.g., a CRT monitor) having operator control buttons thereon. These buttons may represent any of the operationally player controlled functions such as a cash out button 8, bet one credit button 10, player hold/discard buttons 12, 14, 16, 18 and 20, currency or coin slot/acceptor 22, deal/draw button 24, and maximum bet button 26. A first player's hand is shown along line A–A' and a second player's hand is shown along line B–B'. The game is begun, for example, by the player pressing maximum wager button 26 or pressing the wager one credit button 10 the desired amount of times. The deal/draw button 24 is then pressed, or with the maximum bet button 26 being pressed, the deal is automatically started. Upon pressing the maximum bet button 26, the maximum wager for three bet units 28, 30, and 32 is displayed. For any incremental bets (e.g., 1 per hand and per parlay, 2 per hand and per parlay, etc.), the amount of the incremental bet for the three bet units 28, 30, and 32 is displayed. The three bet units 28, 30, and 32 represent the bet unit for the first hand, A–A', the bet unit for the second hand B–B', and the bet unit for the parlay play, respectively.

After the betting has been concluded, the first hand A–A' is displayed. The cards 34, 36, 38, 40 and 42 may be displayed in any manner, turning one card at a time or turning all cards to be face up at the same time. After the complete hand A–A'has been displayed, the resolution and payout of the hand A–A' is performed, based upon a pay table. The pay table (lookup computer table) is used to define the amount of award or payout for the value of the first hand. A typical series of pay table is shown below:

| OUTCOME PAY TABLE I | |
|---|---|
| Royal Flush | 800 to 1 |
| Straight Flush | 50 to 1 |
| Four-of-a-Kind | 25 to 1 |
| Full House | 8 to 1 |
| Flush | 6 to 1 |
| Straight | 4 to 1 |
| Three-of-a-Kind | 3 to 1 |
| Two Pair | 2 to 1 |
| Pair of Sixes or Better | 1 to 1 |
| PAYOUT TABLE II | |
| Royal Flush | 500-to-1 |
| Straight Flush | 100-to-1 |
| Four of a kind | 40-to-1 |
| Flush | 7-to-1 |
| Straight | 5-to-1 |
| Three of a kind | 3-to-1 |
| Two pair | 2-to-1 |
| Jacks or better | 1-to-1 |

The amount paid on the play of the first hand may then be indicated in resolution frame or paid frame 44. After play and/or resolution of the first hand, the second hand B–B', on which the second bet 30 has already been placed, may now be displayed by exposing or displaying cards 60, 62, 64, 66 and 68 that constitute the second hand B–B'. The second hand is then resolved according to a pay table. The pay table for play of the second hand may be the same as that for the play of the first hand (this is convenient when the games are the same) or the pay table for the play and resolution of the second hand may be different. After resolution of the second hand, the artificial intelligence of the apparatus determines if both hands have (each and both) established at least a minimum predetermined rank to qualify for the parlay payout 48 to be paid on the parlay bet 32. If both hands are at least the minimum rank for awards in the parlay bet, the apparatus resolves the parlay bet 32 and indicates the amount of the payout in window 48.

The parlay payout amount may be structured in many different ways, with many different pay tables, but one attractive procedure is to have the amount of the parlay payout based upon the minimum value of one of the two hands that have attained a qualifying minimum rank. For example, if the first hand is two pairs and the second hand is a straight, the parlay award would be based upon both hands being ranked at least as high as two pair. It is also possible to average the payout amount for the parlay bet, as where the first hand is two pairs and the second hand is a straight. The parlay payout could be 'averaged' to three-of-a-kind, the hand rank intermediate that of the actual two hands.

An attractive feature that may be provided in the play of this game is to have the parlay payout amount more than additive with respect to the payout amounts for the play of the first two hands. For example, if the three bets were each $1, and both the first and second hands are Jacks or better (but less than two pair), the payouts would be:

| | |
|---|---|
| First Hand | $1 |
| Second Hand | $1 |
| Parlay Payout | $3 |

The player would win a total of $5 on two winning hands. A typical payout range and payout table for play of Parlay Poker based upon a one unit bet for each bet could be the following, where the outcome for each hand is indicated as the minimum rank of the two hands:

| Outcome | First Game | Second Hand | Parlay Bet |
|---|---|---|---|
| Royal Flush | 250 | 250 | 5,000 |
| Straight Flush | 50 | 50 | 5,000 |
| Four Aces | 160 | 160 | 5,000 |
| Four 2's, 3's, or 4's | 80 | 80 | 5,000 |
| Four 5's–Kings | 50 | 50 | 5,000 |
| Full House | 10 | 10 | 400 |
| Flush | 7 | 7 | 100 |
| Straight | 5 | 5 | 50 |
| Three-of-a-kind | 3 | 3 | 9 |
| Two Pair | 1 | 1 | 5 |
| One Pair | 1 | 1 | 3 |

As can be seen from this pay table, the amounts awarded for the parlay play are capable of being more than the additive amount for the payouts for equal 'winning' hands in the play of the first and second hands. The rules of the game and the pay table may be displayed on the monitor 4 as in a separate display area 52.

Many variations on this exemplary game are possible. For example, the same poker games need not be played in the first and second hands, and even the same number of cards need not be used (e.g., Three card poker, five card poker, and seven card poker may be played in consecutive hands). The payout tables would have to be adjusted accordingly, as they would also if wild card games were played. Although the play of the game has been focused upon video wagering play of poker, it is possible to have the play based on other forms of video games where there are possible events of predictable frequency. For example, parlay play may be used with conventional reel slot programming.

What is claimed is:

1. A method of playing a wagering game with at least two consecutive plays comprising:

placing at least one bet;

receiving at least one first set of symbols from which a rank may be determined in reading the symbols;

determining the rank of the first set of symbols;

comparing the first set of symbols to a payout table;

determining whether the rank of the first set of symbols exceeds a minimum rank in the payout table;

receiving at least a second set of symbols from which a rank may be determined without having placed an additional bet to the at least one bet;

determining the rank of the second set of symbols;

comparing the rank of the second set of symbols to a payout table;

determining whether the rank of said second set of symbols exceeds a minimum rank in the payout table;

resolving the at least one bet with respect to whether a) the first set of symbols exceeds a minimum rank in the payout table; b) the second set of symbols exceeds a minimum rank in the payout table; and c) both the first set of symbols and the second set of symbols exceed a minimum in the payout table.

2. The method of claim 1 wherein the resolution of the bet with respect to whether the first set of symbols and the second set of symbols exceed a minimum rank in the payout table requires that the rank of both the first set of symbols and the second set of symbols both exceed a minimum rank in the payout table for the resolution of the bet on c) to provide a return on the bet.

3. The method of claim 2 wherein the minimum rank of the ranks of the first set of symbols and the second set of symbols determines the amount of any payout for resolution of the bet on c).

4. A method of playing a wagering game of cards with at least two consecutive hands of a card game being played comprising:

placing at least one bet;

receiving at least one first hand of cards from which a rank may be determined;

determining the rank of the first hand of cards;

comparing the first hand of cards to a payout table;

determining whether the rank of the first hand of cards exceeds a minimum rank in the payout table;

receiving at least a second hand of cards from which a rank may be determined without having placed an additional bet to the at least one bet;

determining the rank of the second hand of cards;

comparing the rank of the second hand of cards to a payout table;

determining whether the rank of said second hand of cards exceeds a minimum rank in the payout table;

resolving the at least one bet with respect to whether a) the first hand exceeds a minimum rank in the payout table; b) the second hand exceeds a minimum rank in the payout table; and c) both the first hand of cards and the second hand of cards exceed a minimum in the payout table.

5. The method of claim 4 wherein all ranks are determined as poker ranks.

6. The method of claim 4 wherein said at least one bet comprises three bets, one allocated towards a), one allocated towards b), and one allocated towards c).

7. The method of claim 4 wherein all minimum ranks are at least one pair.

8. The method of claim 7 wherein said at least one bet comprises three bets, one allocated towards a), one allocated towards b), and one allocated towards c).

9. The method of claim 4 wherein all hands are dealt from a deck of playing cards.

10. The method of claim 9 wherein all ranks are determined as poker ranks.

11. The method of claim 9 wherein all minimum ranks are at least one pair.

12. The method of claim 11 wherein said at least one bet comprises three bets, one allocated towards a), one allocated towards b), and one allocated towards c).

13. The method of claim 9 wherein the deck of playing cards is a standard deck of fifty-two cards.

14. The method of claim 13 wherein all ranks are determined as poker ranks.

15. A method of playing a video wagering game with at least two consecutive hands of a card game being played comprising:

placing at least one bet;

receiving at least one first hand of cards from which a rank may be determined;

determining the rank of the first hand of cards;

comparing the first hand of cards to a payout table;

determining whether the rank of the first hand of cards exceeds a minimum rank in the payout table;

receiving at least a second hand of cards from which a rank may be determined without having placed an additional bet to the at least one bet;

determining the rank of the second hand of cards;

comparing the rank of the second hand of cards to a payout table;

determining whether the rank of said second hand of cards exceeds a minimum rank in the payout table;

resolving the at least one bet with respect to whether a) the first hand exceeds a minimum rank in the payout table; b) the second hand exceeds a minimum rank in the payout table; and c) both the first hand of cards and the second hand of cards exceed a minimum in the payout table.

16. The method of claim 15 wherein said at least one bet comprises three bets, one allocated towards a), one allocated towards b), and one allocated towards c).

17. The method of claim 15 wherein the payout table comprises:

| Outcome | First Game | Second Hand | Parlay Bet |
|---|---|---|---|
| Royal Flush | 250 | 250 | 5,000 |
| Straight Flush | 50 | 50 | 5,000 |
| Four Aces | 160 | 160 | 5,000 |
| Four 2's, 3's, or 4's | 80 | 80 | 5,000 |
| Four 5's–Kings | 50 | 50 | 5,000 |
| Full House | 10 | 10 | 400 |
| Flush | 7 | 7 | 100 |
| Straight | 5 | 5 | 50 |
| Three-of-a-kind | 3 | 3 | 9 |
| Two Pair | 1 | 1 | 5 |
| One Pair | 1 | 1 | 3 |

18. The method of claim 15 wherein all ranks are determined as poker ranks.

19. The method of claim 18 wherein said at least one bet comprises three bets, one allocated towards a), one allocated towards b), and one allocated towards c).

20. A method of playing a wagering game of poker comprising:

a) a player wagering on a first game of poker;

b) the player playing said first game of poker;

c) determining if the player wins the first game of poker;

d) if the player wins the first game of poker with a hand exceeding an at least predetermined rank, providing the player with an opportunity to play a second game of poker without placing further wagers; and e) if the player attains a hand in the second game of poker that also exceeds said predetermined rank, a payout is achieved for a) the rank of the first poker hand, b) the rank of the second poker band and c) the occurrence of both the first poker hand and the second poker hand exceeding a specific rank.

21. The method of claim 20 wherein a side bet must be placed to allow the player to receive a bonus payout and the side bet must be wagered prior to step a).

22. A method of playing a wagering game comprising:

placing at least a one part bet;

playing a first wagering game segment whose game outcome depends at least in part upon the random selection of game symbols;

comparing a first segment game outcome to the rules of the game to determine if a payout is associated with the first segment game outcome;

playing at least a second wagering game segment whose outcome depends at least in part upon the random selection of game symbols without placing further wagers; and comparing a second segment game outcome to the rules of the game to determine if a payout is associated with the second segment game outcome awarding the player a first payout when the first segment game outcome is determined to be a winning outcome;

awarding the player a second payout when the at least a second game outcome is determined to be a winning outcome; and when consecutively played first and at least second game segments both have winning outcomes, paying the player a third payout for the consecutive winning outcomes without having placed further wagers other than the at least a one part bet.

23. A method of playing a wagering game with at least two consecutive plays required in each game comprising:

placing a first bet;

receiving at least one first set of symbols from which a rank may be determined in reading the symbols;

determining the rank of the first set of symbols;

comparing the first set of symbols to a first payout table;

determining whether the rank of the first set of symbols exceeds a minimum rank in the first payout table;

receiving at least a second set of symbols from which a rank may be determined;

determining the rank of the second set of symbols;

comparing the rank of the second set of symbols to a second payout table;

determining whether the rank of said second set of symbols exceeds a minimum rank in the second payout table;

resolving the first bet with respect to whether a) the first set of symbols exceeds a minimum rank in the first payout table; b) the second set of symbols exceeds a minimum rank in the second payout table; and c) both the first set of symbols and the second set of symbols exceed a minimum in a third payout table.

24. The method of claim 23 wherein the first payout table and the second payout table are different.

25. The method of claim 23 wherein the first payout table and the second payout table are the same.

26. The method of claim 25 wherein the third payout table is different from the first payout table and the second payout table.

27. The method of claim 23 wherein the first bet is the only bet.

28. The method of claim 27 wherein the first payout table and the second payout table are the same.

29. The method of claim 28 wherein the third payout table is different from the first payout table and the second payout table.

* * * * *